US006171166B1

(12) United States Patent
Oquita

(10) Patent No.: US 6,171,166 B1
(45) Date of Patent: Jan. 9, 2001

(54) INTERLOCKING CHAMBER PIÑATA

(76) Inventor: Ramiro Oquita, 6014 Chandler St., San Diego, CA (US) 92117

( * ) Notice: Under 35 U.S.C. 154(b), the term of this patent shall be extended for 0 days.

(21) Appl. No.: 09/243,025

(22) Filed: Feb. 2, 1999

(51) Int. Cl.[7] ..... A63H 33/00; A63H 3/00; B65D 33/14; B65D 33/02

(52) U.S. Cl. ..... 446/5; 446/73; 446/487; 383/119; 383/22

(58) Field of Search ..... 446/5, 4, 73, 76, 446/79, 487, 488, 489; 383/6, 119, 22, 24, 205

(56) References Cited

U.S. PATENT DOCUMENTS

| | | | | |
|---|---|---|---|---|
| 3,006,532 | * | 10/1961 | Fine | 383/119 X |
| 3,349,992 | * | 10/1967 | Skinner | 383/119 |
| 3,702,675 | * | 11/1972 | Bajo | 446/5 |
| 4,015,364 | | 4/1977 | Oquita . | |
| 4,092,798 | | 6/1978 | Oquita . | |
| 4,167,078 | | 9/1979 | Oquita . | |
| 4,186,514 | | 2/1980 | Oquita . | |
| 4,787,872 | * | 11/1988 | Bajo | 446/5 |
| 4,930,903 | | 6/1990 | Mahoney . | |
| 5,263,889 | * | 11/1993 | Ledonne | 446/5 |
| 5,536,194 | * | 7/1996 | Larsen et al. | 446/5 |
| 5,613,312 | * | 3/1997 | Crowell | 383/7 X |
| 5,824,378 | | 10/1998 | Armendariz et al. . | |

* cited by examiner

*Primary Examiner*—D. Neal Muir
(74) *Attorney, Agent, or Firm*—Knobbe Martens Olson & Bear LLP

(57) ABSTRACT

A container, typically for use as a piñata is disclosed. The container comprises a containing chamber having an opening on one side, and a plurality of handles fixably attached to the containing chamber and extending outwardly from the opening of that chamber; a pull line, fixably attached to the chamber, the pull line passing through at least one face of the chamber, so that when the pull line is pulled with sufficient force the chamber will rupture; and a shroud chamber having an opening on one side, and a plurality of slots on a side opposite the opening of the shroud chamber, that chamber being positioned atop the containing chamber to shroud the opening of the containing chamber with the side opposite the opening of the shroud chamber. The handles of the containing chamber are inserted into the slots of the shroud chamber so as to interlock the chambers. When the shroud chamber is thus positioned atop and interlocked with the containing chamber, it shrouds the opening of the containing chamber with the side opposite the opening of the shroud chamber.

19 Claims, 4 Drawing Sheets

INTERLOCKING CHAMBER PIÑATA

BACKGROUND OF THE INVENTION

1. Field of the Invention

This invention pertains to the field of containers, particularly those containers used as amusement devices and games of chance or of combinations of chance and ability, and even more particularly, to the type of containers commonly known as piñatas.

2. Description of the Related Technology

Pinata breaking celebrations are quite popular in Mexico and in the Mexican communities of the United States. Traditionally, pifiatas are constructed of a clay pot or container ornamented with colorful paper and filled with candy, nuts, confetti, and/or token gifts such as light-weight toys and the like, collectively referred to as treats. The piñata is suspended above a party area and at the appropriate time and with celebration, the piñata is broken so that the treats are scattered among the several guests who in turn may generally keep whatever treats each collects. The usual method of breaking the piñata is by beating it with a club or cane. This is done by a blindfolded participant—usually, but not necessarily, a child—who is the subject of the celebration. Alternatively, several participants in succession are each given a certain number of turns in which to attempt to break the pifiata. Unfortunately, as a result of the enthusiasm of one or more of the participants in gathering close to the pi ñata so as to collect a larger number of treats, it occasionally happens that a participant in the celebration is hit by the club or by the cane used to break the piñata. Additionally, the traditional piñata made of clay pottery may break into large fragments which can fall and cause injury. Modern piñatas are often made of paper mache or cardboard, thereby avoiding some of the dangers presented by cracked clay fragments. However, modern piñatas are generally more difficult to break, requiring greater swings with the resultant greater danger from that aspect to the participants.

Storage and transportation for traditional, and even modem, piñatas are awkward and difficult because of the bulkiness of an assembled, ready-to-use piñata. Furthermore, even modern piñatas are relatively difficult, expensive, and time-consuming to construct in a ready-to-use state, and often must be stored with treats inside for long periods of time. This requirement of extensive storage in a ready-to-use state often precludes the use of perishable treats, such as many types of candies and gums, in the pi ñatas.

Accordingly, there exists a need for containers, and especially piñatas, that are not awkward, difficult, or expensive to store, and for piñatas that may be easily stored without treats enclosed, and constructed just prior to use. Additionally, there exists a need for containers, especially pi ñatas, that are made of relatively inexpensive materials, and that are neither expensive nor time-consuming to construct into a ready-to-use state. Finally, there exists a need for such piñatas that can be easily constructed into a ready-to-use state by those with no special training.

SUMMARY OF THE INVENTION

The present invention includes a container, typically for use as a piñata, which comprises a "containing" chamber, which may be a conventional paper bag, having an opening on one side, and a plurality of handles fixably attached to the containing chamber and extending outwardly from the opening of the chamber; at least one pull line that is fixably attached to the chamber, the pull line passing through at least one face of the chamber, so that when the pull line is pulled with sufficient force the chamber will rupture; and a "shroud" chamber having an opening on one side, and a plurality of slots on a side opposite the opening of the shroud chamber. The shroud chamber may be a conventional paper bag and may be laminated, and is positioned atop the containing chamber to shroud the opening of the containing chamber with the side opposite the opening of the shroud chamber, so that the handles of the containing chamber may readily be inserted into the slots of the shroud chamber to stabilize the entire container and to shroud the opening of the containing chamber with the shroud chamber, specifically, the side opposite the opening of the shroud chamber. Ribbons, with attached cards thereto, may also be used with the piñata.

BRIEF DESCRIPTION OF THE DRAWINGS

The accompanying drawings, which form part of the specification, merely illustrate embodiments of the present invention. Together with the remainder of the specification, they are meant to serve to explain the principles of the invention but do not limit the scope of the scopes.

DETAILED DESCRIPTION OF THE CERTAIN EMBODIMENTS

Figure 1:
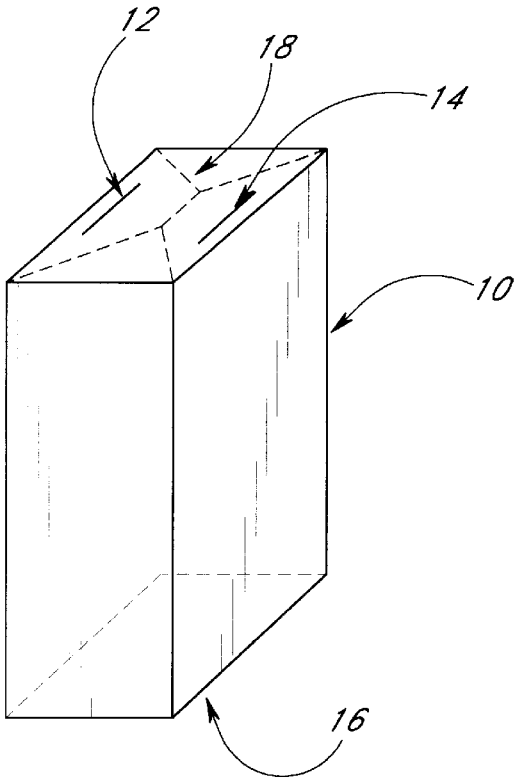
FIG. 1 illustrates an isometric view of a shroud chamber of a piñata of the invention.

The present invention provides a container, typically for use as a piñata or as part of a game of chance, which avoids the foregoing dangers and limitations inherent in currently used piñatas, and greatly reduces the storage and transportation difficulties inherent in currently used piñatas and related containers. Accordingly, the purposes of this invention include, but are not limited to, the following: is: (i) an enclosed container that may be conveniently stored and formed, and more particularly, (ii) a piñata that may be conveniently stored and formed, (iii) a piñata that is neither costly nor mechanically difficult to construct, (iv) a piñata that avoids the dangers to participants inherent in the use of currently-available piñatas, (v) a piñata that is, at least in part, reusable, (vi) a piñata that may serve as an advertisement and/or may represent the commercial source of the treats contained inside the piñata, (vii) a piñata that exhibits an advertisement or logo that may act as a possible inducement to participate in the celebration as a way to obtain identified treats, (viii) a visually pleasing piñata, and (ix) a piñata that invokes the active participation of the participants by directing the participants to complete tasks in turn, or to answer questions in turn, to perform similar deeds.

To achieve at least one of the above-stated purposes, the present invention provides a container, typically for use as a piñata or as part of a game of chance, constructed out of at least two interlocking chambers or sacks or other devices having multiple closed sides and at least one opened side.

The invention provides an outer chamber herein referred to as a shroud chamber or, alternatively as a "second" chamber, which may be fancy or decorated, and may include, or even be completely covered by, an advertisement or logo, or may be designed so as to represent a wrapping for a piece of candy or gum. Such an advertisement, logo, or candy or gum wrapper representation has the additional benefit of being indicative of the treats that are contained in the completed, ready-to-use piñata. Preferably this chamber is a paper bag of the conventional type, but may be made of any material and may have any shape, while keeping in mind the purposes of the invention. Specifically, this chamber is may be a laminated paper bag that may be used multiple times with distinct piñatas. Such a laminated paper bag will be more durable than a conventional paper bag and will be easily folded and stored. This shroud chamber need not rupture to achieve any of the purposes of the invention. As will be understood by those of skill in the art, such a preferred shroud chamber, i.e., a laminated paper bag of the conventional type, has a rectangular folded bottom and side folds, the bag being of generally rectilinear shape, such that the chamber may be conveniently folded and stored in a flattened state, and may have attached handles.

The invention also provides an inner chamber herein referred to as a containing chamber or, alternatively as a "first" chamber, used to support and enclose a plurality of treats, such as candy, toys, and the like. This chamber is composed of frangible material, and may be a paper bag of a conventional type. Preferably this chamber is a paper bag of the conventional type, but may include bags of all materials and shapes, so long as the purposes of the invention are not all defeated. A paper bag of the conventional type, has a rectangular folded bottom and side folds, the bag being of generally rectilinear shape, such that the chamber may be conveniently folded and stored in a flattened state and may have handles attached.

Additional chambers may be placed atop or joined with the above-described chambers as desired.

In one embodiment, the container of the invention is formed in the following manner; the outer, shroud chamber and inner, containing chamber are oriented so that their sides having openings are flush against one another, objects to be stored inside the container having been placed in the containing chamber, and the side having an opening face on the shroud chamber is then slid over the containing chamber, so that a closed side of the shroud chamber opposite the opened side of the shroud chamber serves to cover the opened side of the containing chamber. The handles of the containing chamber are inserted into the slots of the shroud chamber so as to interlock the chambers. When the shroud chamber is thus positioned atop and interlocked with the containing chamber, it shrouds the opening of the containing chamber with the side opposite the opening of the shroud chamber.

To form a piñata or game-related container of the invention, a plurality of ribbons may also be removably attached to the inner containing chamber to provide color and appropriate decor, as well as to provide a disguise for a winning ribbon. A winning ribbon is attached to a pull line which, when pulled with sufficient force, will rip or rupture the inner chamber and thus release the treats from within that chamber, and out through an opened side of the outer, shroud chamber and out to the game's participants. Alternatively, plurality of ribbons, each separately removably attached to the inner chamber, provide a disguise for one or several winning ribbons, each of which is attached, either collectively or separately, to a single or to multiple pull lines which, when pulled with sufficient force, will each rupture the inner chamber and release the treats from within that chamber and out through the opened face of the outer shroud chamber and out to the game's participants. In one embodiment, a plurality of "non-winning" ribbons are removably attached to the inner chamber by means of separate paper clips, and a single winning ribbon is employed.

The above-mentioned pull line, which may be a nylon fishing line, a piece of high-tensile-strength wire, a piece of dental floss, or the like, is affixed to a single winning ribbon and to a distinct point on the inner containing chamber. Furthermore, the pull line is may be threaded through apertures in the inner containing chamber. These apertures are large enough to allow the pull line to pass through, but not large enough to allow any of the treats to pass through, unless and until the containing chamber is ruptured in the above-described manner. Thus, these apertures can be made with a toothpick or pin hole, and are not reinforced. These apertures may be perforated to encourage rupture of the chamber along predetermined lines. In one embodiment, the toothpick or pin holes are connected to one or more perforations in the inner chamber to facilitate rupture of the inner chamber upon pulling of the winning ribbon with sufficient force. Accordingly, the pull line is long enough to thread through a toothpick or pin hole at one end of one face of the inner chamber and back up through another pin hole at the other end of that face of the inner chamber, and to a point on another face of the inner chamber to which it is affixed.

When the "winning" ribbon is pulled with sufficient force, the pull line tears the inner containing chamber. The pull line may be initially positioned with respect to the inner chamber in the following manner: it is threaded through the above-described holes and pulled through the inner chamber and may be affixed to the chamber by being tied to a handle of this chamber. When the pull line is drawn taunt, the corresponding ribbon to which it is attached hangs inconspicuously at the same length as the other "non-winning" ribbons. In this manner, the "non-winning" ribbons provide a disguise for the single or for multiple winning ribbons, the only ribbons that are attached to one or, as the case may be, multiple pull lines.

Ribbons, both those connected to the pull line and those not so connected, can be affixed with a label or card, generally at a location on either the upper end or the lower end of the ribbon. These labels may include writings in which questions are asked, deeds are assigned, or prizes may be awarded to the participant. These questions, deeds, prizes or the like are selected so as to be suitable for the participants of the game. For example, simple questions may be used for a child's birthday group, and academic questions used for a school party. Also, as may be appropriate for occasion, deeds may include singing a birthday song, requests that the participant dance on his head, or the like. In one embodiment of the invention, each participant will pull a ribbon in sequence until the winning ribbon is pulled and the inner bag is accordingly ruptured by the person who finds the, or a, winning ribbon, i.e., a ribbon affixed to a pull line. Prior to pulling the winning ribbon, the participants engage in the activities described on the labels, for instance, answering questions or executing specific activities e.g., dance like a duck.

To form a completed, ready-to-use piñata of the invention, the outer chamber is used to serve as a shroud to cover the opened face of the inner chamber. In the preferred embodiment of the invention, this may be accomplished by inverting the :shroud chamber from its normal, open-face-up position and placing the inverted shroud chamber over the inner containing chamber, which remains in its open-face-up orientation. In this way, an enclosure is formed by an essentially closed face of the shroud chamber and the essentially closed faces of the containing chamber, as an essentially closed face of the shroud chamber covers the opened face of the containing chamber. Alternatively, the inner chamber, loaded with treats, may be inverted and placed within the shroud chamber, but such a method of forming the piñata has the disadvantage of allowing the treats to spill out of the desired enclosure formed by the shroud chamber the containing chamber. Additional chambers may be placed upon the piñata as desired.

Furthermore, as is noted above, piñatas are traditionally suspended above a party area. Accordingly, the containing chamber of invention may have affixed handles. The handles serve to suspend a completed (or ready-to-use) piñata, supporting in an upright orientation the containing and shroud chambers as well as the enclosed treats and any ribbons and pull lines that form part of the piñata. Desirably, to support the ready-to-use piñata and to retain its desired shape, these handles pass through slots formed in the essentially closed face of the shroud chamber that is opposite the opened face of the shroud chamber. These handles will serve to support the suspended inner, containing chamber, with its contents of treats, its attached ribbons, and pull line, as well as to support the shroud chamber. The handles may be fixably attached to the containing chamber in any conventionally known manner, such as by glue, staples, or the like, provided the handles are sufficiently durable to serve to support an entire ready-to-use piñata.

The piñata of the present invention may, of course, be constructed from readily available materials as described herein. Alternatively, a kit may be provided for easy of construction. Such a kit will, at a minimum, provide an inner, containing chamber, to replace a previously ruptured containing chamber, through holes in which may be passed a pre-positioned pull line. Typically, such a kit will also provide a plurality of ribbons and means to removable attach those ribbons, each separately, to the inner, containing chamber.

An advantage of providing the piñata of the present invention as a kit will also be realized if a shroud chamber is provided in the kit. Such a shroud chamber, may optionally have located on it a logo or advertisement of the manufacturer, supplier, or sponsor of the kit. Thus, the kit itself could also contain and serve as an advertisement for the treats to be enclosed in the piñata. Of course, the kit may also include cards, upon which are written text of graphics detailing the tasks or questions that comprise part of the game to be played.

Reference is now made to the figures, which are incorporated in and form part of the specification, and merely illustrate preferred embodiments of the present invention. FIG. 1 illustrates an outer, shroud chamber 10 that will comprise much of the visible exterior of the completed pi ñata. The shroud chamber may be a high quality bag made of laminated paper, plastic, or the like and may be shipped in a folded or collapsed condition. A plurality of slots are located at what will ultimately be the top face of the shroud chamber of the completed piñatas. In the embodiment shown in FIG. 1, the chamber 10 has two slots 12 and 14. The open end of the bag 10 is shown facing down 16. The closed end of the bag is shown at the top of the FIG. 1. Dashed lines in FIG. 1 illustrate how and where the shroud bag of the invention may be collapsed as a conventional paper bag.

Figure 2:
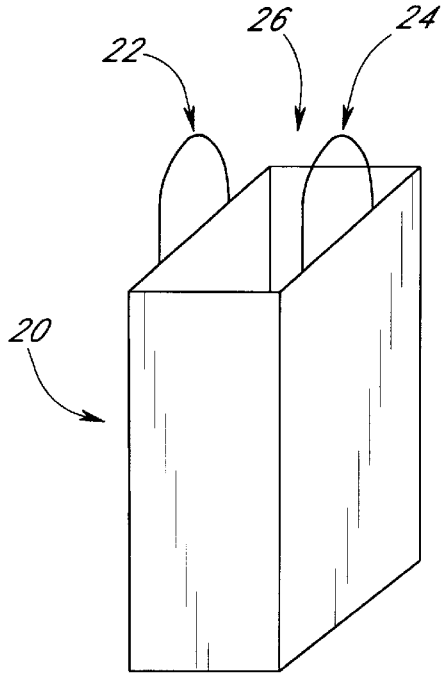
FIG. 2 illustrates an isometric view of a containing chamber of a piñata of the invention.

FIG. 2 illustrates an inner, containing chamber 20 of the piñata of the present invention. This bag, as with the shroud bag is preferably rectilinear shape and is a high quality bag made of paper. It may be laminated paper, plastic or the like so long as the purposes of the inventions are not all defeated. Such bags may be shipped in a folded or collapsed condition. The containing chamber 20 has affixed to it, two handles 22 and 24. This pair of handles form a mirror image across the opened face of the containing chamber. The handles 22 and 24 may be of any suitable type shape or confirmation, and are illustrated in FIG. 2 as relatively stiff cord-like members connected to the bag in a conventional orientation. The handles may be attached to the containing chamber by gluing, stapling, and affixing with tapes, and other methods, as will be understood by those of skill in the art. The treats used with the piñata are typically inserted in the container bag 20 through the open end of the container bag 26. Thus, fully assembled, the piñata will contain treats for dispersion once the piñata is ruptured.

Figure 3:
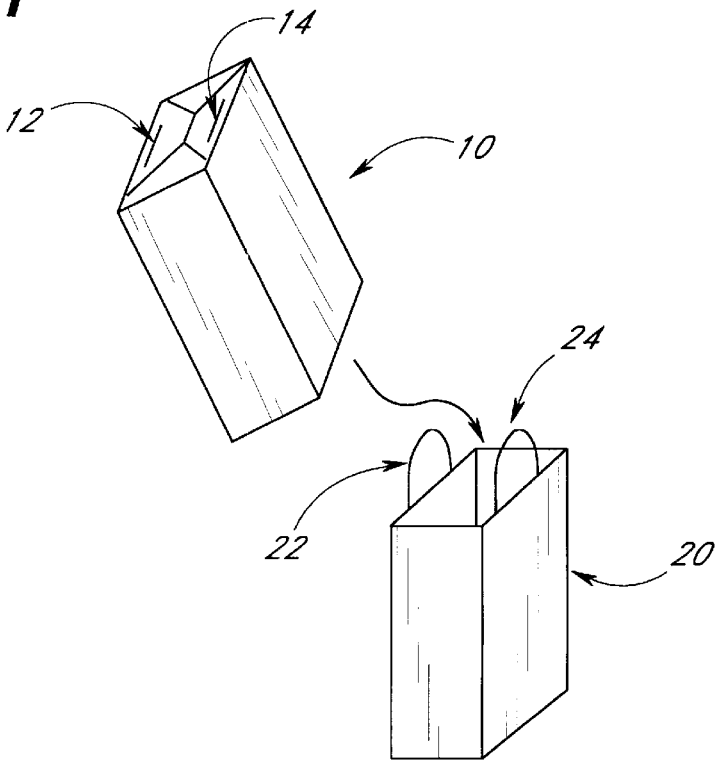
FIG. 3 illustrates the placement of a shroud chamber of FIG. 1 over a containing chamber to form an enclosed container, such as a piñata of the invention.

FIG. 3 illustrates a manner in which the shroud bag 10 may be placed over the containing bag 20 to form the piñata. Specifically, the slots of the shroud bag 12 and 14 are fit over, and designed, such that they receive the handles of the containing bag 22 and 24 respectively when the shroud bag 10 is place over the containing bag 20. It is envisioned that the material forming the containing bag 20 may be slightly collapsed to allow a like-sized shroud bag 10 to fit over a containing bag 20 and allow for the handles 22 and 24 of the containing bag to fit into the slots 12 and 14, respectively, of the shroud bag.

It will be understood that the slots of the shroud bag 12 and 14 may be formed in a number of manners. They may be cut out of pre-formed chambers with scissors, knives, and the like, or they may move simply be created as slots when the shroud bag is manufactured in any conventional manufacturing method. Furthermore, the slots may be reinforced in a number of ways, including but not limited to by the use of glues, adhesive tape, threaded stitching, and the like.

Figure 4:
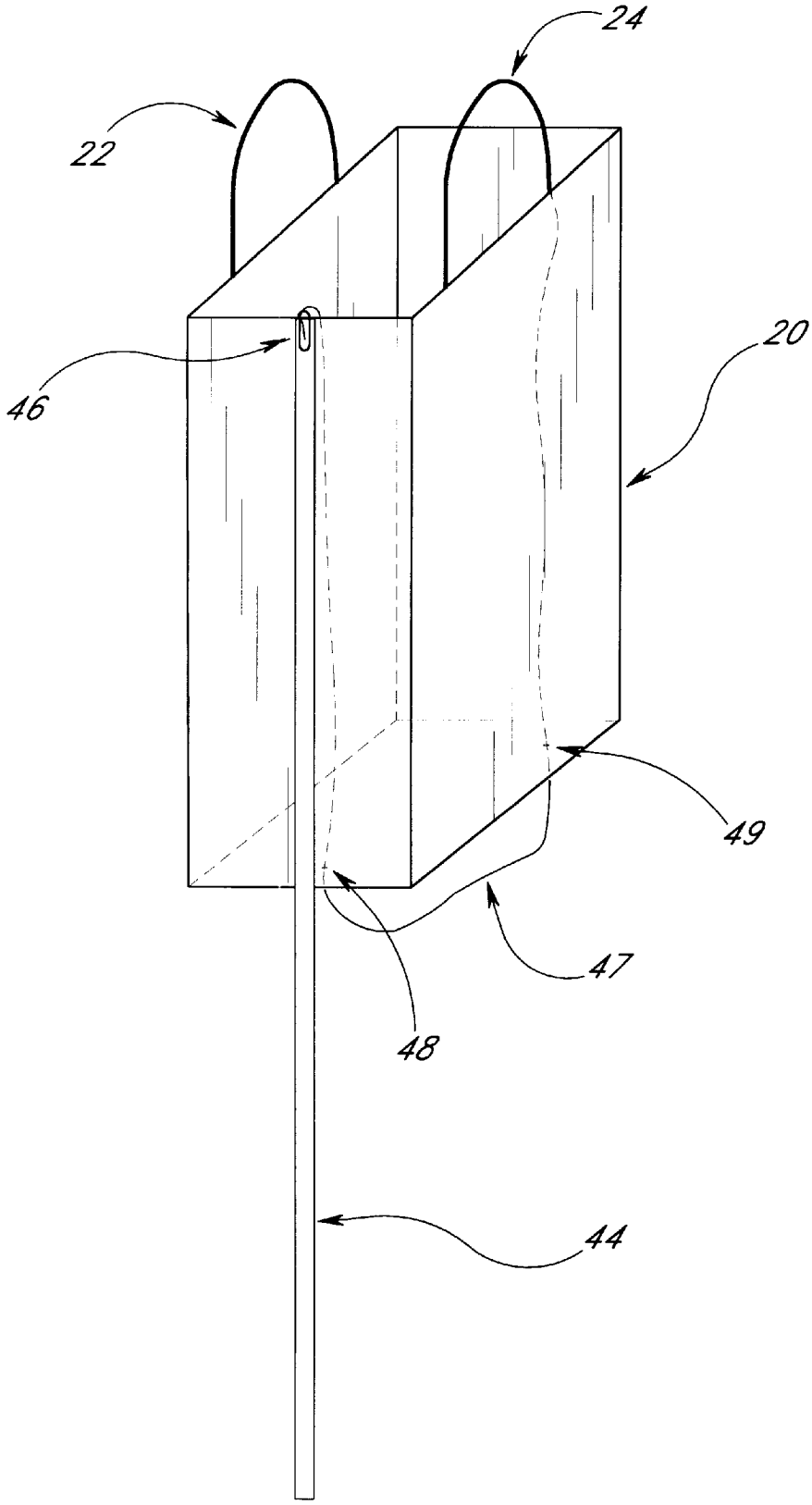
FIG. 4 illustrates an isometric view of a containing chamber of the invention and, specifically, illustrates an attached ribbon and a pull line affixed, at one end, to that ribbon and, at the other end, to the containing chamber.

FIG. 4 illustrates a ribbon removably attached to the containing chamber of the invention. Specifically, the ribbon 44 is removably attached by means of a paper clip 46. Of course, ways other than paper clips may be suitable to removably attach the ribbon to the containing chamber of the invention, including adhesive tape, staples, and the like.

The ribbon 44, the winning ribbon of FIG. 4, is fixably attached to a pull line such that when the ribbon is subject to a sufficient downward force, applied by participant in the game, the pull line will tear away a substantial portion of the closed bottom of the containing chamber and rupture that chamber. As illustrated in FIG. 4, a pull line 47 is fixably attached to the ribbon 44 at top of the containing bag near a paper clip 46. When a pole ring 44 is pulled, the pull line 47 is drawn taught and tears the bottom portion of the containing bag from a hole 48 to a hole 49, or a portion of the bottom between the holes 48 and 49. Furthermore, the pull line 47 is connected fixably to the containing chamber 20 near handle 24 so that when the ribbon 44 is pulled vertically down with sufficient force, the pull line 47 is drawn taught, but remains fixably attached to a containing chamber near the handle 24. Alternatively, the pull line 47 may be attached to other locations of the containing chamber or directly to the handle 24 or to the handle 22, or even the shroud chamber or another interconnected chamber.

Figure 5:
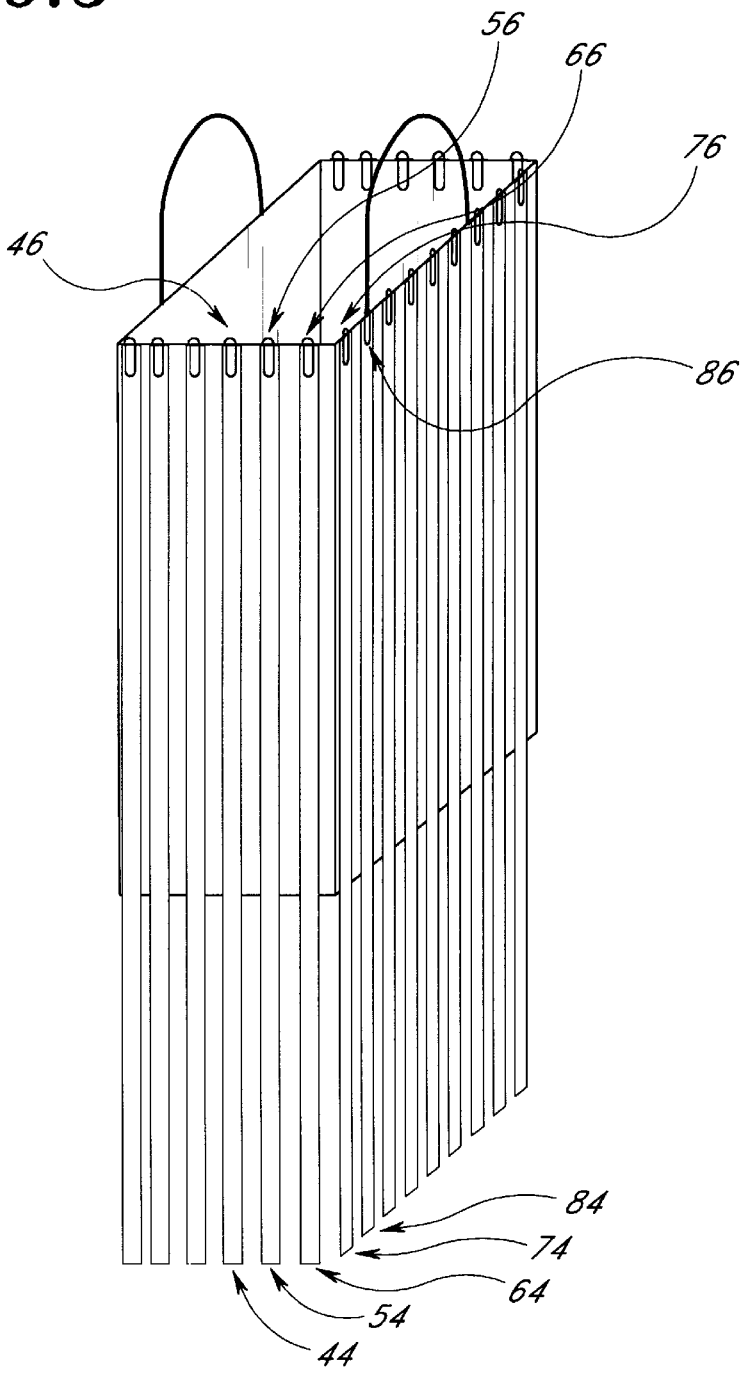
FIG. 5 illustrates an isometric view of a containing chamber of a piñata of the invention having removably attached ribbons.

FIG. 5 illustrates a containing chamber, having a plurality of ribbons removably attached thereto. The ribbon 44 and the paper clip 46, as shown in FIG. 4, are also illustrated in FIG. 5. Additionally in FIG. 5, a ribbon 54 and a corresponding paper clip 56 are shown with numerous ribbons and paper clips, used to removably attach the ribbons to the containing chamber. The pull line attached to the ribbon 44 is obscured and not shown in FIG. 5. A number of ribbons 54, 64, 74, and 84 are shown to illustrate four distinct ribbons. The remaining ribbons are not assigned numerals, but as will be appreciated, the characteristics of the ribbons 54, 64, 74, and 84 apply to the remaining ribbons. For example, the ribbon 54 is attached to the containing chamber in manner similar to the ribbon 44. That is, the ribbon 54 is removably attached by means of a paper clip 56. Similarly the ribbon 64 is removably attached to the containing chamber by means of a paper clip 66. The ribbon 74 is attached to another face of the containing chamber 20 by a paper clip 76, and the ribbon 84 is removably attached to the same face of the containing chamber as ribbon 74, again by another distinct additional paper clip 86. Further ribbons are attached in series across each of the four vertical faces of the containing chamber by means of paper clips as shown in FIG. 5. These ribbons may be decorated, or display numerous colors so as to make the piñata festive, or to match the exterior colors of the piñata, or to reflect a theme of the party or event in which the piñata is intended to be used.

Figure 6:
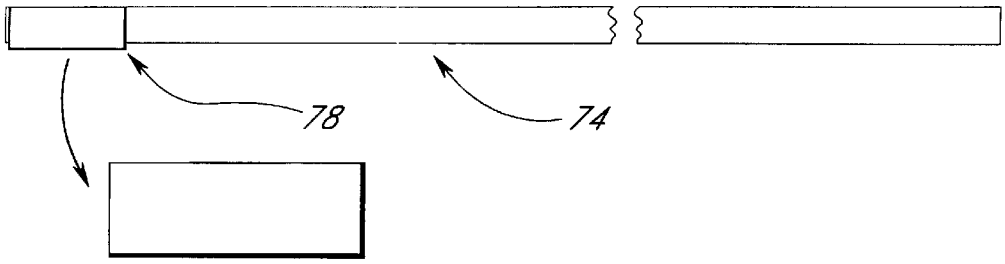
FIG. 6 illustrates an embodiment of the invention in which a tag, on which tasks, questions, or the like may be written, is placed at one end of the ribbon.

FIG. 6 illustrates an embodiment of the invention in which the ribbons may contain specific deeds or tasks or questions, as will be chosen to be appropriate for the participants in the piñata game or for the celebration or party in which the piñata game is used. Specifically, in FIG. 6, the ribbon 74 is shown as an example. Attached to the ribbon 74 either at the top or bottom end, or if deemed appropriate but not illustrated, near the middle of the ribbon, is a small card or label 78. The card 78, text or other graphic representations may be written indicating that the participant in the game, usually the one who pulled the ribbon, may be required to answer a question, perform a task, or execute a deed. The card may also be machine-readable, so that the card may be read only by a machine such as a machine equipped with a computer, and the machine may then output one or more questions or instructions to the participant. As will be appreciated by those of skill in the art, the question, task, or deed can be chosen to be appropriate for those playing the game or for the theme of the party in which the piñata is used.

Figure 7:
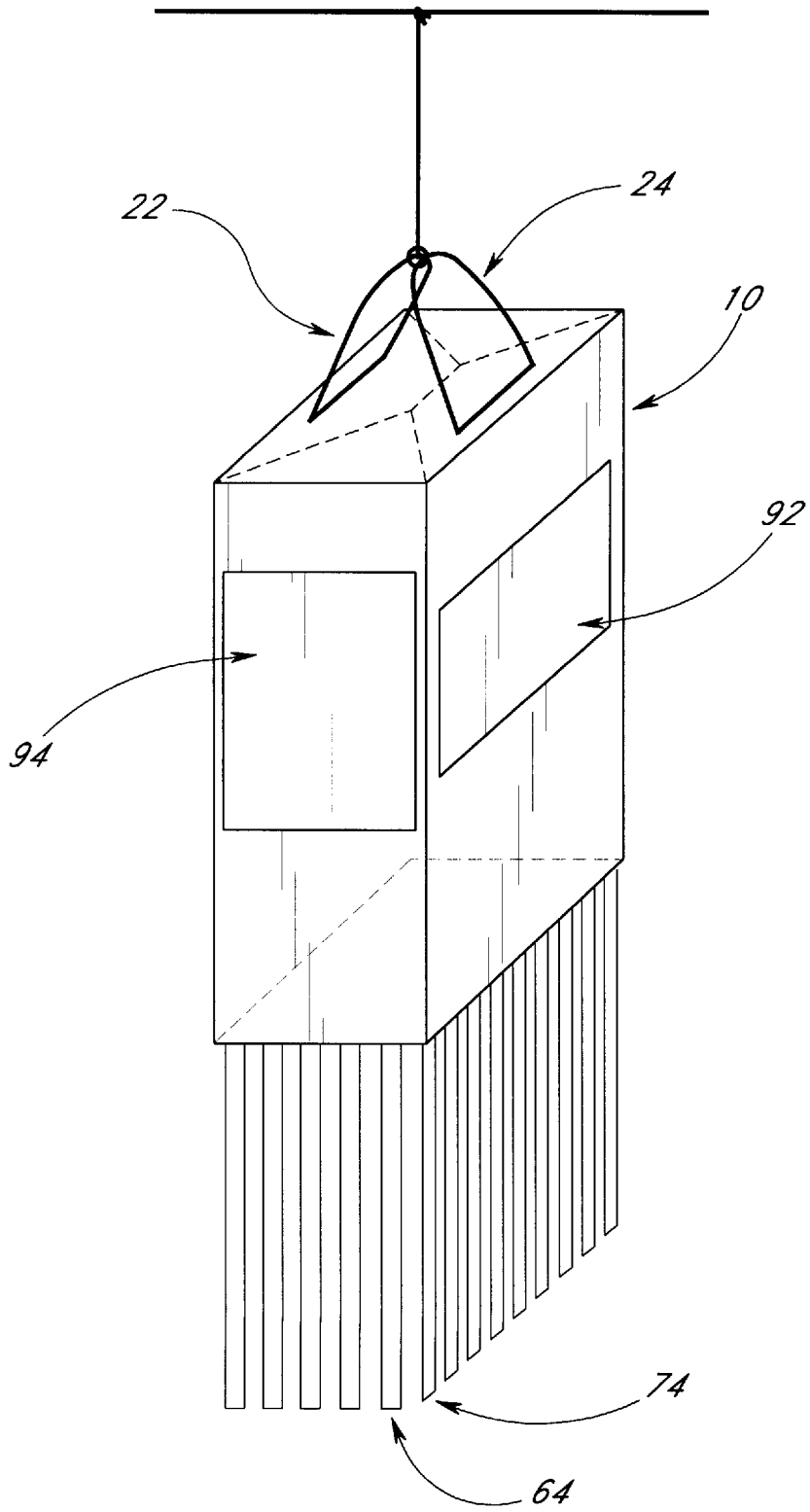
FIG. 7 illustrates an isometric view of a completed piñata of the invention in a ready-to-use state.

FIG. 7 shows a completed embodiment of the piñata hanging suspended from a single line in an upright position so that it may be used as intended. Naturally, multiple lines or a greater number of handles may be used to effectively suspend the piñata in an upright position. Shown in FIG. 7 are handles 22 and 24, tied together by a cord suspended from a ceiling, or other high structure. The containing chamber, which is largely obscured in FIG. 7, is covered by the shroud chamber 10 while the lower portions of the ribbons are exposed, as is the exterior of the shroud chamber 10. Advertisement or logos may be placed on the shroud chamber in, for example, at two locations 92 and 94. Furthermore, the entire shroud chamber may be decorated with logos or designs on the faces 92 and 94 as well as the other faces exposed on the shroud chamber. Alternatively, the entire shroud chamber may be covered with an advertisement or logo, or be designed so that it appears to be a candy or gum wrapper or the like. The ribbons, removably attached to the containing chamber, are shown, and are visible even as the shroud chamber 10 covers the containing chamber 20. Specifically, the ribbons 64 and 74 are shown in FIG. 7.

While specific embodiments of the invention have been shown and described in detail to illustrate the application of the principles of the invention, it will be understood that the invention may be embodied otherwise without departing from such principles.

What is claimed is:

1. A piñata, comprising:

a first chamber having an opening on one side, and a plurality of handles fixably attached to the first chamber and extending outwardly from the opening of the first chamber;

a first ribbon removably attached to the first chamber;

a pull line, fixably attached at one point to the first ribbon and at another point to at least one face of the first chamber, so that when the first ribbon is pulled with sufficient force the first chamber will rupture;

a plurality of additional ribbons removably attached to the first chamber; and a second chamber having an opening on one side, and a plurality of slots on a side opposite the opening of the second chamber, the second chamber being positioned atop the first chamber to shroud the opening of the first chamber with the side opposite the opening of the second chamber, wherein the handles of the first chamber are inserted into the slots of the second chamber when the second chamber is positioned atop the first chamber to shroud the opening of the first chamber with the side opposite the opening of the second chamber.

2. The piñata of claim 1, wherein the first and second chambers are of a generally rectilinear shape.

3. The piñata of claim 1, wherein the chambers are composed of paper.

4. The piñata of claim 1, wherein the chambers are paper bags of a conventional type.

5. The piñata of claim 1, wherein a logo is located on the second chamber, such that when the second chamber is positioned atop the first chamber to shroud the opening of the first chamber with the side opposite the opening of the second chamber, the logo is visible from the exterior of the piñata.

6. The piñata of claim 5, wherein the logo simulates the wrapper on a candy package.

7. The piñata of claim 5, wherein the logo simulates the wrapper on a gum package.

8. The piñata of claim 1, wherein a paper clip is used to removably attach the first ribbon to the first chamber.

9. The piñata of claim 1, wherein separate paper clips are used to removably attached each separate ribbon to the first chamber.

10. The piñata of claim 1, wherein the colors of the ribbons are selected so that ribbons of at least three different colors are removably attached to the first container.

11. The piñata of claim 1, wherein separate cards are attached to each of the plurality of ribbons, and the cards include text specifying distinct tasks.

12. The piñata of claim 1, wherein separate cards are attached to each of the plurality of ribbons, and the cards include text specifying distinct questions.

13. The piñata of claim 1, wherein the pull line is comprised of tape.

14. The piñata of claim 13, wherein the pull line is comprised of a fibrous tape.

15. The piñata of claim 1, wherein the pull line is fixably attached to an inner face of the first chamber.

16. The piñata of claim 1, wherein the second chamber comprises paper having a tubular shape.

17. The piñata of claim 16, wherein the second chamber further comprises a paper disk to form the side opposite the opening of the second chamber.

18. The piñata of claim 1, wherein an adhesive is used to removably attach the first ribbon to the first chamber.

19. The piñata of claim 1, wherein separate adhesives are used to removably attached each separate ribbon to the first chamber.

* * * * *